United States Patent [19]

Gernhardt et al.

[11] Patent Number: 4,720,213

[45] Date of Patent: Jan. 19, 1988

[54] APPARATUS FOR INSPECTING, CLEANING AND/OR PERFORMING OTHER TASKS IN CONNECTION WITH A WELDED JOINT

[75] Inventors: Michael L. Gernhardt, Houston; Edward W. Hughes, Jr., Katy, both of Tex.

[73] Assignee: Oceaneering International, Inc., Houston, Tex.

[21] Appl. No.: 26,282

[22] Filed: Mar. 16, 1987

[51] Int. Cl.[4] ..... B63C 11/52

[52] U.S. Cl. ..... 405/190; 15/104.04; 405/188; 405/195; 405/211

[58] Field of Search ..... 405/169, 185, 188, 190, 405/191, 195, 211; 15/104.04; 114/312, 313

[56] References Cited

U.S. PATENT DOCUMENTS 3,698,197 10/1972 Bodey et al. ..... 405/188
3,851,492 12/1974 Cannon et al. ..... 405/191
4,043,134 8/1977 Mason ..... 405/188

FOREIGN PATENT DOCUMENTS 2027473 2/1980 United Kingdom ..... 405/185

*Primary Examiner*—David H. Corbin
*Attorney, Agent, or Firm*—Vaden, Eickenroht, Thompson & Boulware

[57] ABSTRACT

An apparatus is disclosed for inspecting, cleaning and/or performing other tasks in connection with a welded joint between intersecting tubular members of an offshore platform a substantial distance beneath the water surface. The apparatus includes a support body adapted to be moved onto and removed from one of the tubular members, and a carrier rotatable about the body, when clasped about the one tubular member, and having the task performing devices thereon for traversing the joint as the carrier is so rotated.

6 Claims, 12 Drawing Figures

APPARATUS FOR INSPECTING, CLEANING AND/OR PERFORMING OTHER TASKS IN CONNECTION WITH A WELDED JOINT

This invention relates generally to apparatus for use in inspecting, cleaning and/or performing other tasks in connection with a welded joint. More particularly, it relates to improved apparatus of this type in which the welded joint connects intersecting tubular members of an offshore platform which are located a substantial depth beneath the water surface.

It is common practice to perform tasks in and around subsurface portions of offshore platforms by means of vehicles which are remotely operated from the surface level. These vehicles, which are known in the trade as ROV's, have thrusters or other suitable means for propelling them through the water in response to the supply thereto of a source of power located on the top of platform or a vessel near the platform. Thus, a package comprising one or more task performing devices is delivered by the ROV to the desired site where each device is then positioned relative to the ROV to perform its intended task by means of a manipulator which, like the vehicle itself, is operated from a remote power source. Power is delivered to the vehicle, and thus to the task performing devices and their manipulators, and signals are transmitted between the vehicle and a control station on the platform or vessel, through an umbilical connecting the vehicle and station. The vehicle may be lowered to and raised from the level at which it is to operate by means of a cage which may be lowered from and then raised back to the surface level and to which the ROV is connected by means of a tether which permits the ROV to maneuver at such level.

An ROV whose task performing package includes devices for inspecting and/or cleaning a welded joint is so large that it is difficult to maneuver in and around the restricted area of the framework of the platform in which the joint is located, especially when it requires a large and cumbersome umbilical for performing other tasks as well as propelling the ROV itself into and out of desired positions. Hence, the ROV often must be repositioned many times in order to enable the task performing package to traverse the joint in order to perform the desired tasks thereon, since once the ROV is positioned, the maneuverability of its task performing devices is limited to that of their manipulators. Also, in order that it may be fixedly positioned at or near the work site for this purpose, the vehicle has been provided with suction cups adapted to be attached to an adjacent area of the framework of the platform, ordinarily the intersecting tubular member whose peripheral and edge is welded to the other member. This proves difficult because of the need for first removing marine growth from the member or other piece to which the cup is attached.

Attempts have been made to improve upon apparatus of this type by providing individualized task performing packages adapted to be interchangeably attached to a basic ROV. Although this reduces the size of the overall vehicle, it nevertheless is subject to other shortcomings above noted. Also, it may require recovery and redeployment of the ROV to exchange one such package for another. In any event, the delivery and other functions of the ROV are necessarily shut down until the joint has been inspected and/or cleaned.

Co-pending patent application, Ser. No. 726,798, entitled "Method and Apparatus for Inspecting, Cleaning and/or Performing Other Tasks in Connection With A Welded Joint", filed Apr. 24, 1985, by Michael L. Gernhardt, and assigned to the assignee of the present application, relates to apparatus in which the task performing package may be maneuvered in and around the restricted areas in which the joint may be located, which does not require repositioning of the ROV or other delivery package for the purpose of enabling the work performing package to traverse the welded joint in inspecting, cleaning or performing other tasks at the job site, and in which the task performing package may be positioned for traversing the joint with a minimum of time and effort.

More particularly, the illustrated embodiment of the prior apparatus includes a support body which is adapted for connection to a delivery package so that it may be moved onto and clamped about the tubular member whose peripheral end edge is welded to the other member, and a carrier having means for inspecting, cleaning and/or performing other tasks in connection with the joint and so mounted on the body for rotating about it, when the body is so clamped, whereby such means is caused to traverse the joint independently of the delivery package. More particularly, the apparatus has means which is remotely operable, in response to the supply thereto of power from a remote source, for selectively clamping the support body about or unclamping the body from the tubular member, rotating the carrier about the support body, and activating the task performing means as it traverses the joint during rotation of the carrier.

Since the apparatus is clamped to the tubular member, the tubular member need not be cleaned or otherwise prepared. Furthermore, due its relatively small size and thus its ability to be maneuvered in and around the work site, the apparatus may include a task performing package for performing a large number of tasks in connection with the joint. Preferably, the ROV or other delivery package may be removed from the apparatus when the support body has been clamped about the tubular member, and prior to traversing the joint, whereby the ROV may be deployed for other tasks.

The power for operating the components of the apparatus may be received through an umbilical connecting it to the ROV to which power is in turn supplied through an umbilical connecting with a power source on a vessel at water level. This same power source may also be used to operate manipulators connecting the task performing means with the carrier, and, when the means for cleaning the joint is a jet nozzle, for supplying the jetting fluid thereto from a remote source. Alternatively, power may be supplied to the components independently of the ROV, such as directly from a source on the cage or at the water surface.

In the prior apparatus, each of a main portion of the body which is clamped to the tubular member and the carrier mounted on it have throats in their sides to permit them to be moved onto or removed from the tubular member when the carrier is moved to a position in which its throat is generally aligned with that of the main body portion. The carrier is rotated about the body by means of a partial ring gear extending about its outer circumference generally from one side to the other of its throat, and pinion gears mounted on the main body portion to drivingly engage the teeth of the ring gear.

In an underwater environment, debris may accumulate between the teeth of a conventional ring gear, and meshing of the pinion gear with the teeth merely mashes the debris more firmly into the valleys between them. As a result, unless the debris is removed, the gears may jam and the carrier rendered incapable of rotation. Also, the pinion gears are rotated by remotely operable actuators including a hydraulic motor or the like, and if the power source is lost, because of severing of a hydraulic line leading to the motor or otherwise, the carrier may be locked in a rotative position on the body which prevents its removal from the tubular member.

An object of this invention is to provide apparatus of this type in which the means for rotating the carrier is less liable to become jammed, and, more particularly, in which the carrier is rotated by means of such construction that there is little tendency for debris to accumulate between its teeth, and which is self cleaning in the sense that debris which might form is automatically removed therefrom during rotation of the carrier.

Another object is to provide apparatus of this type in which the carrier may be rotated to a position in which the apparatus may be removed from the tubular member even though the actuator is rendered inoperable, whether by power failure or otherwise, to return the carrier to a position in which its throat is aligned with that of the main body portion, and more particularly in which the pinion gears may be moved out of driving engagement with the carrier by means which may be manipulated by a diver who may then manually rotate the carrier.

These and other objects are accomplished, in accordance with the illustrated embodiment of this invention, by apparatus which is similar to that disclosed in the prior co-pending application in that it includes a support body including a main portion having a throat in one side and means connected to the main portion for movement between outer positions to one side of the throat to permit the main portion to be moved onto or removed from the one member whose peripherial end edge is welded to another member, and inner positions tightly engaged with the one member for clamping the body thereabout. Also, a carrier is mounted on the support body for rotation thereabout and has a throat in one side thereof which, when the carrier is in a first rotative position, is generally aligned with the body throat to permit the carrier to be moved with the body onto or removed from the one tubular member. As in the prior apparatus, the carrier has means thereon for inspecting and/or cleaning the joint as the carrier is rotated into other positions about the body, and a means is provided for supplying power from a remote source for moving the clamping means between inner and outer positions, rotating the carrier about the body, and activating the means for inspecting, cleaning and/or performing other tasks in connection with the joint.

In accordance with the novel aspects of the present invention, the means for rotating the carrier comprises pins which are mounted on the carrier in circumferentially spaced relation to form a partial ring of teeth concentrically of the axis of rotation of the carrier and extending generally from one side to the other of the throat in the carrier. More particularly, pinion gears are mounted on the main body portion with their teeth arranged to successively move into and out of the open spaces between the pins in order to rotate the carrier upon rotation of the pinion gears. Due to the open spaces between the teeth, there is little or no tendency for debris to accumulate between them, as might occur in the case of a ring gear of conventional construction. Furthermore, debris which might accumulate within the open spaces will be removed as the teeth on the pinion gear move successively into and out of the spaces between the pins on the carrier.

In the illustrated embodiment of the invention, the means for rotating each gear comprises a frame mounted on the body, a shaft rotatably mounted on the frame and on which the pinion gear is mounted, a second gear on the shaft, and a double acting, hydraulically operated actuator having a rod with a worm thereon engaging the second gear for rotating it and thus the shaft and pinion gear in response to reciprocation of the rod. Also, the main body portion has an outer circumferential groove arranged concentrically of the axis of rotation of the carrier and extending between opposite sides of the throat in the main body portion, and the carrier has an inner circumferential flange guidably slidable in the groove. More particularly, the pins on the carrier are disposed generally radially opposite and outwardly from the flange, and the pinion gears on the body are disposed radially intermediate the pins and flange, to provide a very compact arrangement having working parts which are disposed inwardly of the outer dimensions of the apparatus and thus protected from damage.

More particularly, the pinion gears on the main body are mounted for moving between positions drivingly engaged with and disengaged from the partial ring of teeth, and a manually manipulatable means is provided for moving the pinion gears between such positions so that they may be moved out of driving engagement with the teeth to permit the carrier to be rotated independently of the actuators for rotating the pinion gears. Thus, in the event the actuator is jammed or otherwise malfunctions with the carrier in a position which locks the apparatus on the tubular member, a diver may move the gears to positions in which he may then manually rotate the carrier into a position in which its throat is generally aligned with that of the body to permit removal of the apparatus from the tubular member.

In the illustrated embodiment of the invention, the aforementioned frame is pivotally mounted on the main body portion between positions in which the pinion gear thereon is drivingly engaged with or disengaged from the teeth of the ring. Each of the main body portion and frame have cam slots therein to receive a follower rod having an arm thereon which may be manually manipulated to move the follower laterally within the slots, and the slots are so contoured as to swing the frame between said positions as the rod is so manipulated, whereby the arm may be moved by the diver to manipulate the rod and thus move the pinion gear to the desired positions.

In the drawings, wherein like reference characters are used throughout to indicate like parts:

Figure 1:
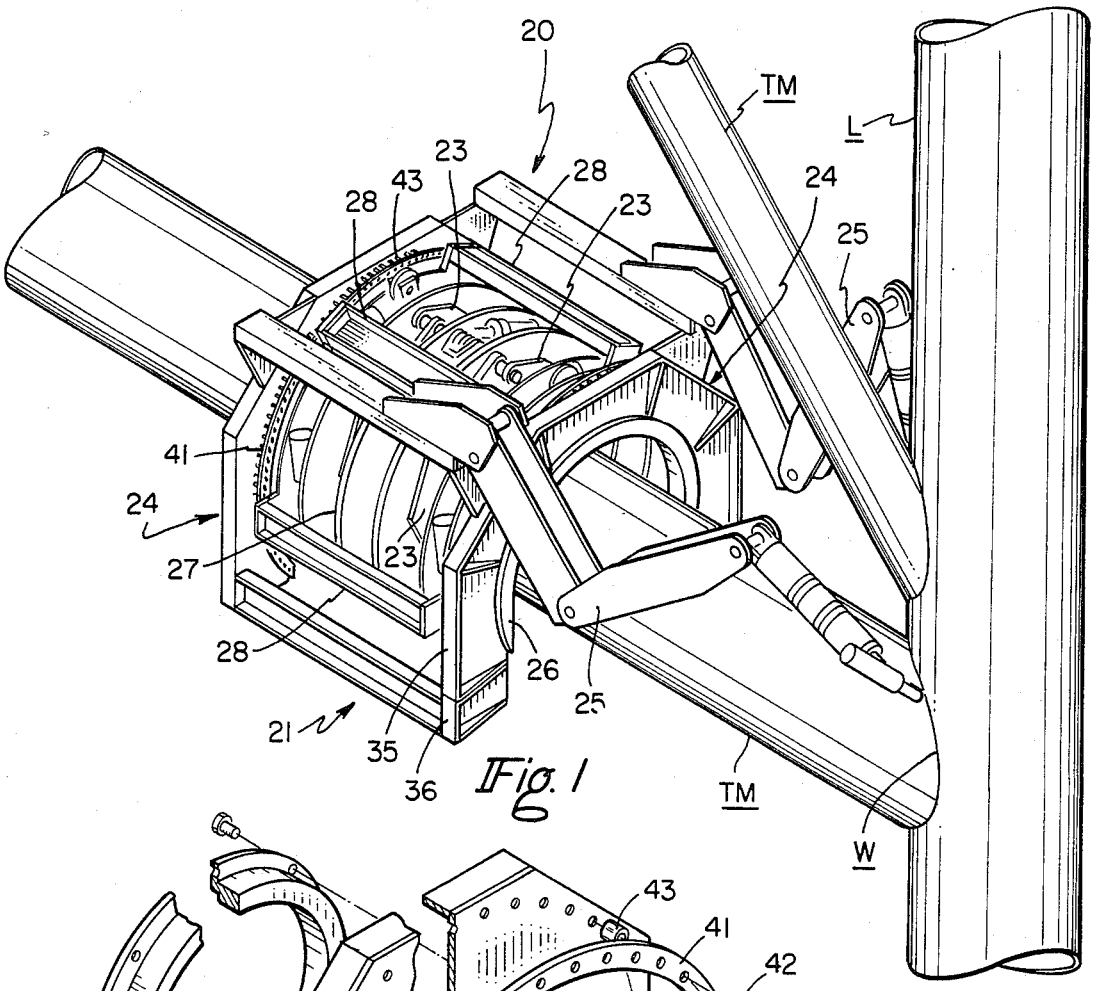
FIG. 1 is a perspective view of the apparatus mounted on a tubular member to dispose the means for inspecting, cleaning, or performing other tasks in connection with a welded joint between that member and another intersecting tubular member, of an underwater platform in position to traverse the joint during performance of the tasks.

The portion of the underwater platform shown in FIG. 1 includes a substantially upright leg L which is anchored at the underwater surface for extension upwardly to the water level, and horizontally and diagonally extending tubular members TM connecting with the leg L to form part of a rigid framework. More particularly, the peripherial end edges of the tubular members are welded to the leg by means of annular welds W, which, as can be seen from FIG. 1, are in areas which are restricted due to the relatively small angle formed between the members. The apparatus constructed in accordance with the present invention, and indicated in its entirety by reference character 20, is shown to be so mounted on the horizontal tubular member as to enable it to perform certain tasks on the welded joint between it and the leg L.

Figure 4:
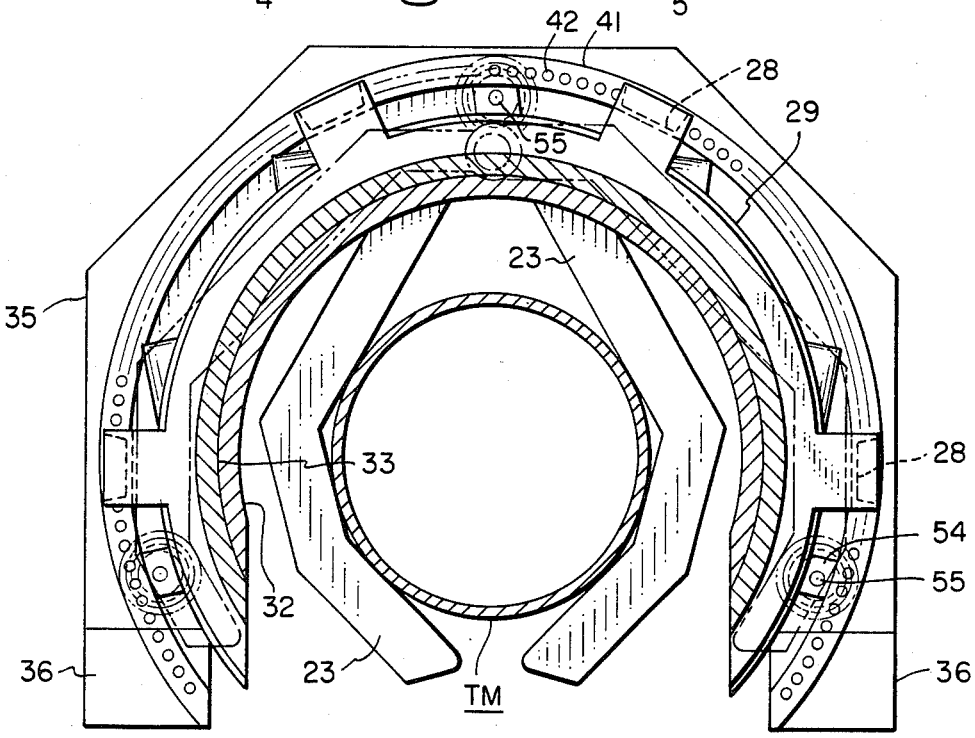
FIG. 4 is a cross-sectional view of the apparatus, as seen along broken lines 4—4 of FIG. 2, and with the clamping arms shown by solid lines in positions clamped about the body and in phantom in releasing positions.
Figure 3:
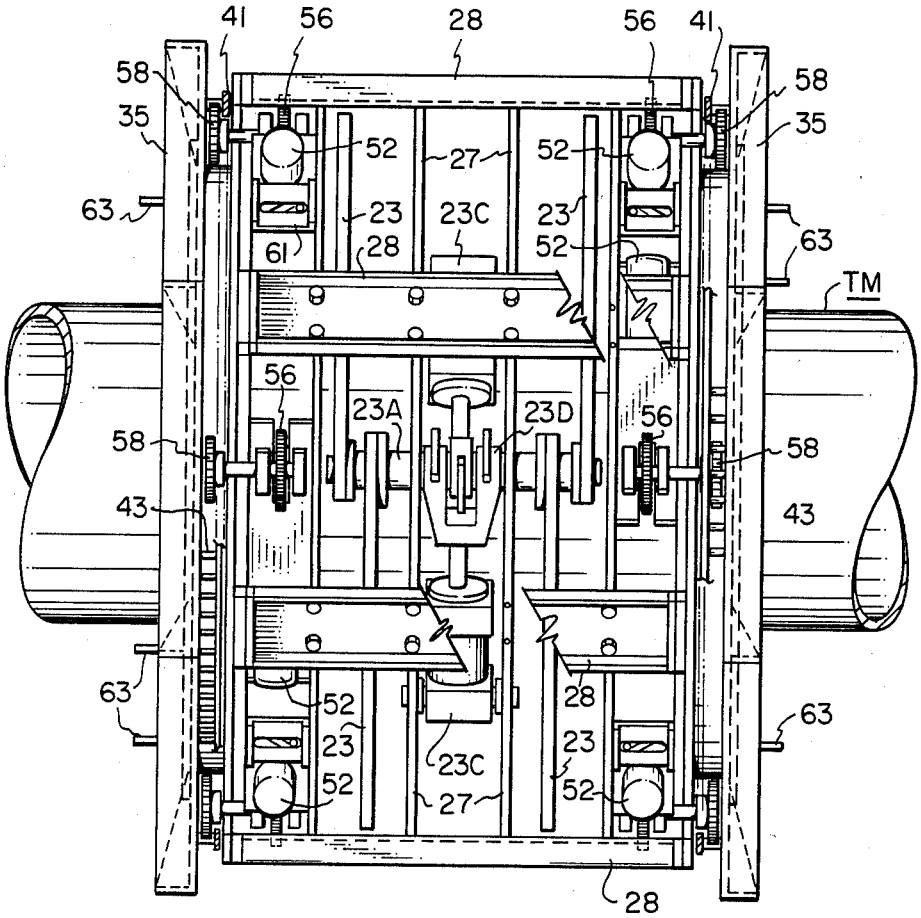
FIG. 3 is a top view of the apparatus of FIG. 2.
Figure 7:
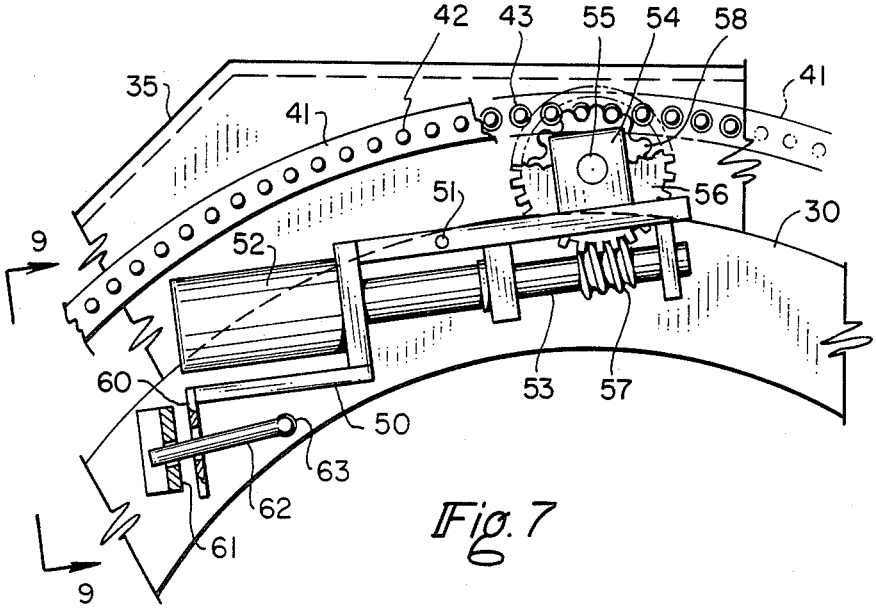
FIG. 7 is an enlarged detailed view of the means on the main body portion for rotating the carrier.
Figure 5:
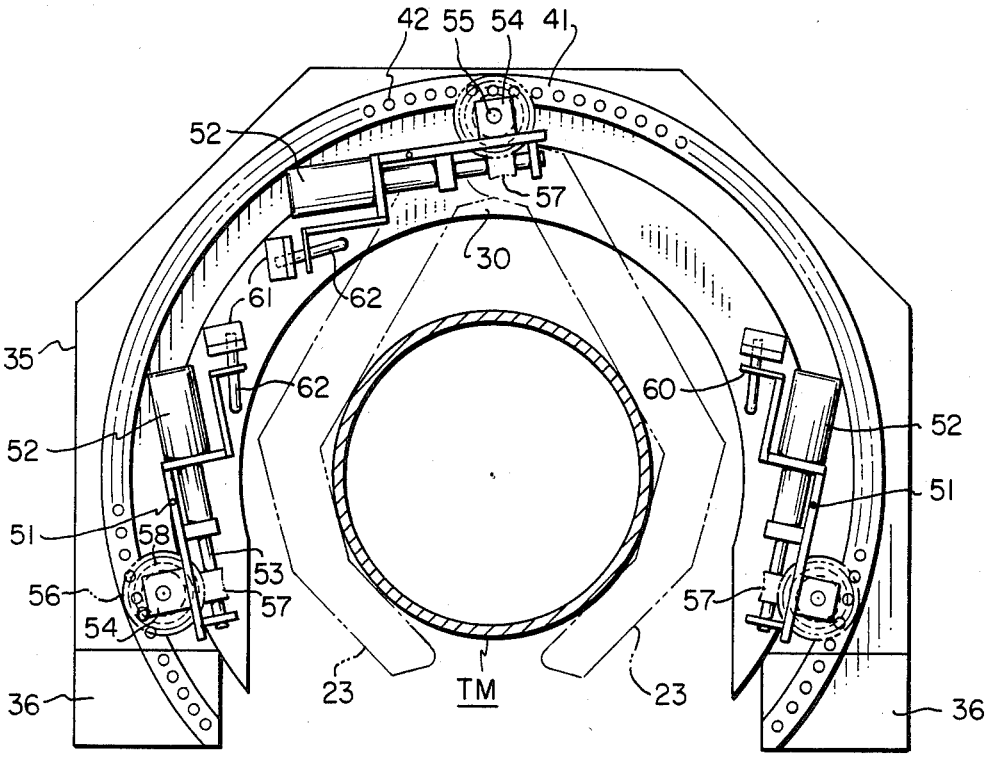
FIGS. 5 and 6 are cross-sectional views of the apparatus, as seen along broken lines 5—5 of FIG. 2, with the carrier rotated in FIG. 6 to a position across the throat in the main body portion.
Figure 6:
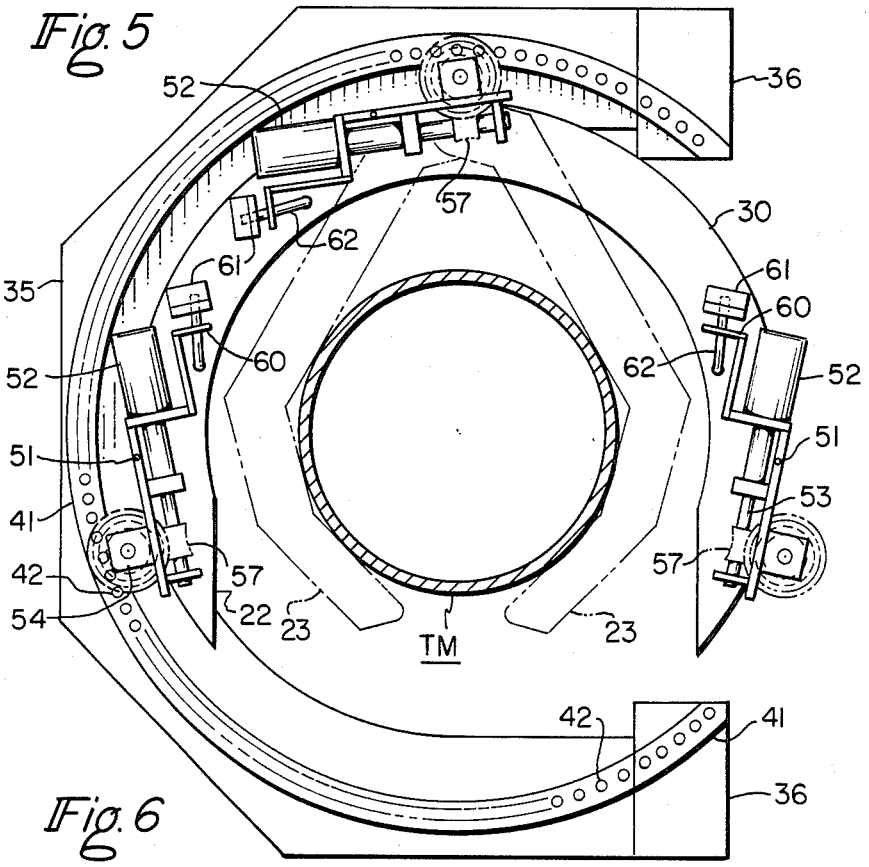
Figure 8:
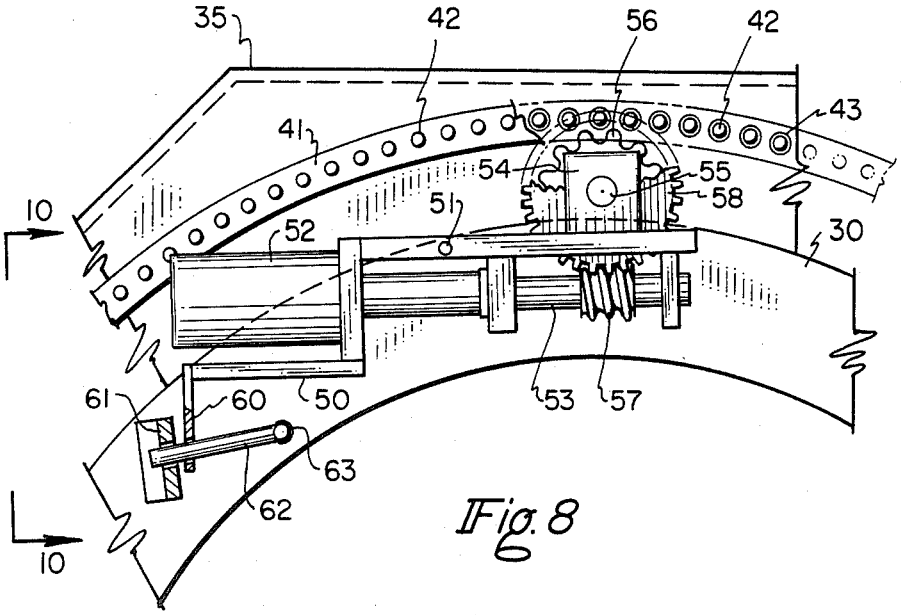
FIG. 8 is a view similar to FIG. 7, but upon movement of the pinion gears out of driving engagement with the partial ring of teeth on the carrier.
Figure 11:
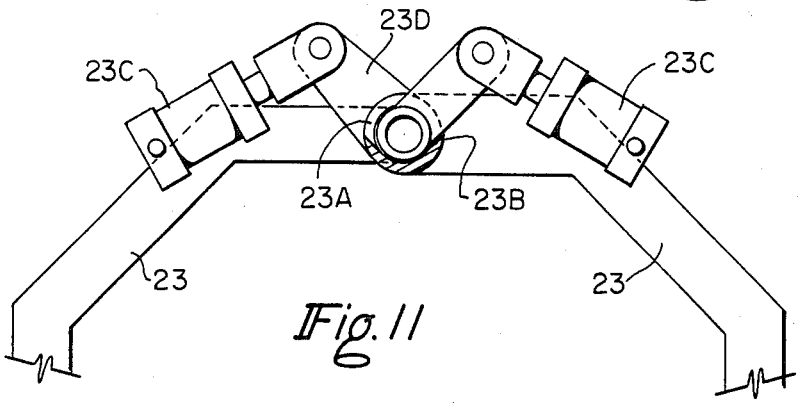
FIG. 11 is an enlarged detailed view of the pivotal connection of the upper ends of the clamping arms to the main body portion and the actuators for moving the clamping arms between clamping and releasing position.

This apparatus comprises a main body portion 21 which, as best shown in FIGS. 4, 5 and 6, has a throat 22 in one side to permit it to be moved onto or removed from the horizontal tubular member, and arms 23 which are hingedly connected to the main body portion generally opposite the throat 22 for swinging between positions to one side of the throat, as shown in phantom in FIG. 4, as the body is moved onto or removed from the tubular member, and positions tightly engaged with the tubular member so as to clamp the body portion thereon, as shown in solid lines in FIGS. 4, 5 and 6. As best shown in FIG. 11, the upper ends of the arms on one side of the body are connected to an inner sleeve 23A and the upper ends of the arms on the other side are connected to an outer sleeve 23B rotatable about and extending from opposite ends of the inner sleeve. The inner sleeve is rotatably mounted on the main body portion and the rods of actuators 23C mounted on the main body are connected by crank arms 23D to the inner and outer sleeves in order to rotate the cranks and thus swing the clamping arms between clamping and unclamping positions in response to extension and contraction of the actuators.

As previously described, the apparatus also includes a carrier 24 mounted on each end of the body for rotation about the main body portion, and, as shown in FIG. 1, task performing devices are mounted on the carrier by means of manipulator arms 25 supported on the carrier at one end for extension and retraction toward and away from the apparatus, and thus for moving the devices on their ends into and out of positions for traversing the welded joint upon rotation of the carrier. As shown, each such carrier also has a throat 26 in one side thereof which, when generally aligned with the throat in the main body portion of the apparatus, permits the apparatus to be moved onto or removed from the tubular member. As more fully described in the prior co-pending application, the devices on the ends of the manipulator arms may comprise, for example, a TV camera or a nozzle adapted to deliver a fluid jet to the welded joint, and the manipulator arms are of conventional construction including hingedly connected joints adapted to be extended and contracted by suitable hydraulically operated means on the carrier.

The apparatus is adapted to be delivered to and lowered onto the tubular member, and then removed therefrom, by means of an ROV which, as well known in the art, and as described in the prior co-pending application, is provided with thrusters or other means for enabling it to be maneuvered within the water to and from desired positions relative to the platform. Thus, the ROV is connectable to the apparatus to permit the apparatus to be moved into and removed from mounted position on the tubular member, and, when the apparatus has been clamped to the tubular member, may be released from the apparatus for deployment at another location, leaving the apparatus for the purposes to be described.

As also previously described, the ROV has means which is hydraulically operated not only to permit it to be so maneuvered, but also to permit it to transmit power from a suitable source to the operating means on the apparatus, including the above described clamping arms and manipulators as well as other parts to be operated, as will be described to follow. Alternatively, and again as described in the prior application, the apparatus may instead be delivered to and removed from the tubular member by a package other than the ROV, as for example by one or more divers, especially when the welded joint is at a depth which permits divers to maneuver for longer periods of time than is possible at greater depths. Also, power for operating the various components of the apparatus may be supplied to a control station on the apparatus from a source other than that which is supplied to and used to operate the ROV.

Figure 2:
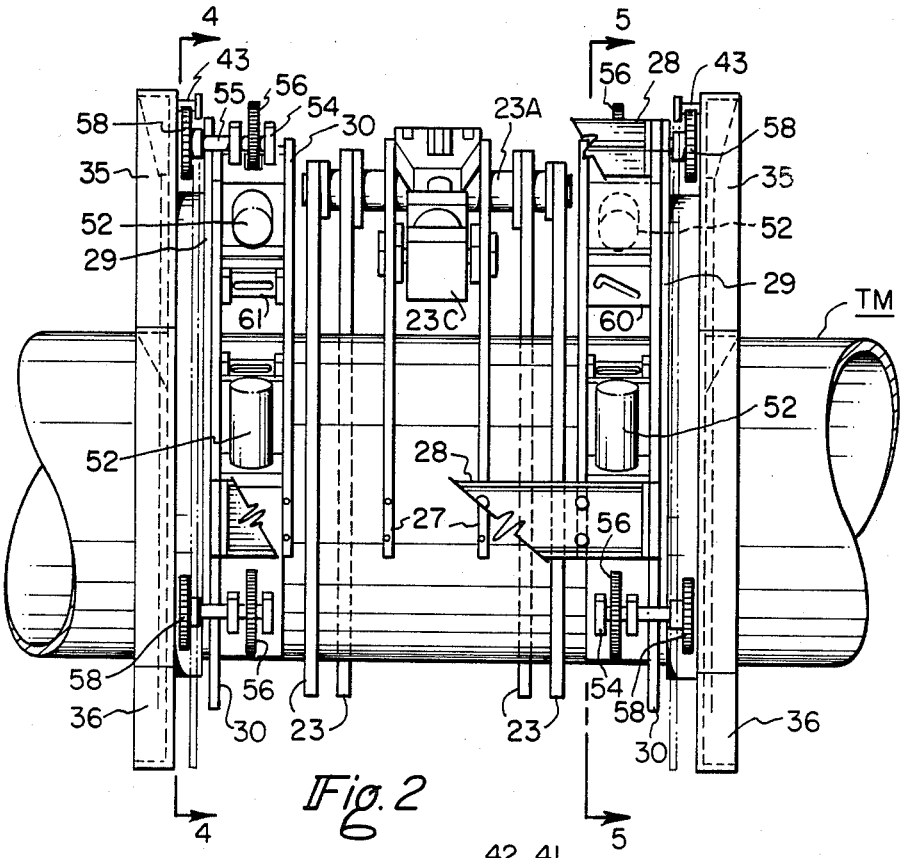
FIG. 2 is a side view of the apparatus mounted on the tubular member, with parts of the main body portion removed for purposes of clarity.

As shown, the main portion 21 of the body is made up of a series of longitudinally spaced apart plates which are of inverted U-shape and connected to one another by lateral bracing, each of the plates having a throat in one side aligned with the throats in the others. These plates include an inner pair 27 which are spaced apart to receive the crank arms and actuators therebetween, as best shown in FIG. 2, and are connected to one another as well as to outer spaced apart plates 29 and 30 at each end of the main body portion by lateral braces 28 which extend longitudinally along the sides and upper portion of the main body portion.

Figure 12:
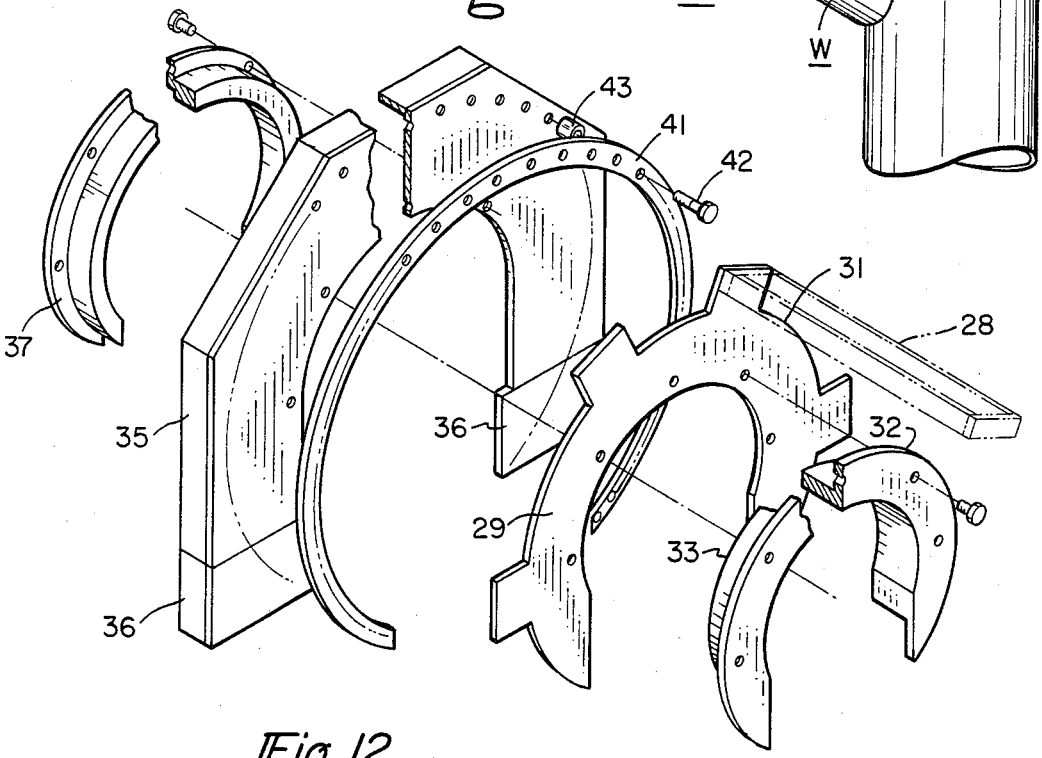
FIG. 12 is a perspective, exploded view of parts of the carrier ring and main body portion at one end of the apparatus.

As best shown in FIG. 12, each outer plate 29 includes a first "U" shaped plate portion 31 to which the ends of the lateral braces 28 are connected, and a second, "U" shaped plate portion 32 having a flange 33 on its outer side which extends through the upper end of the throat in the plate portion 31. When assembled, the plate portions 31 and 32 are bolted or otherwise connected together and a ring 34 (see FIG. 9) is welded to the outer circumference of the outer end of the flange of the plate portion 32 so as to form a circumferential groove G between it and the outer side of the plate portion 32 which extends circumferentially from one side to the other of the throat formed in the plate 29. Each plate 30 is connected to the lateral braces to dispose it in a position spaced from the inner side of the plate 29 for purposes to be described to follow.

The carrier 24 at each end of the apparatus comprises an inverted U-shaped frame 35 which has an outwardly extending flange along the top and sides thereof, and a lower extension 36 which, when the carrier is mounted on the main body, as will be described, permits the entire apparatus to be supported on a flat surface with the main body and the clamping arms raised above the surface. Another inverted U-shaped member 37 of the carrier has a radially outwardly extending flange 38 and a longitudinally inwardly extending flange 39 which extends through the upper end of the throat in the frame 35. The lower side of the flange 39 fits closely within and is rotatably slidably mounted in the groove 35 in the plate 29 of the main body portion to permit each carrier to be rotated about the axis of the tubular member when mounted thereon. More particularly, the flange which is slidable within the groove extends throughout substantially the same arcuate extent as the throats in the plates of the main body, so that with the carrier in the upright position, the throats which are formed in the carriers are generally aligned with one another and those of the main body portion to permit the apparatus to be moved onto or removed from the tubular member as a unit.

Each carrier also includes a partial ring 41 which is connected to the frame 35 on its inner side by means of bolts 42 and spaced therefrom by means of sleeves 43 about the bolts. The ring and the row of bolts are arranged concentrically of the axis of the rotation of the carrier and extend in equally spaced relation from one side to the other of a throat in the side of the ring aligned with the throats in the frame 35 and "U" shaped member 37. The bolts thus provide a partial ring of spaced-apart pins on teeth radially outwardly of the flange 39 and thus in position to be drivingly engaged by pinion gears mounted on the body, as will be described to follow.

A series of frames 50 are disposed between and pivotably connected to the pairs of spaced plates 29 and 30 of the main body portions by means of a pin 51 extending between them. A hydraulically operable actuator 52 is mounted on the frame 50 to dispose the rod 53 thereof in position to be extended and retracted with respect to the length of the frame. Brackets 54 are mounted on the frame near the end of the rod to support a shaft 55 for extension laterally therefrom, and a gear 56 is mounted on the shaft intermediate the brackets in position to be engaged by worm 57 mounted on the rod 53, whereby extension of the rod rotates the shaft in one direction and retraction thereof rotates the shaft in the opposite direction.

The shaft 55 extends beyond the plate portion 31 and has a pinion gear 58 on its outer end whose teeth are positioned to drivingly engage between the equally spaced apart teeth formed by the pins 42. Thus, rotation of the shaft through extension of contraction of the actuator rod 53 will cause the pinion gear to drivingly engage the teeth on the carrier to move the carrier in a desired direction with respect to the main body portion. In this way, of course, the various devices mounted on the outer ends of the manipulator arms are able to traverse the welded joint. Due to the arcuate extent of the partial ring of teeth, as well as the location of the pinion gears opposite the opening of the throat of the main body portion, the carrier is driven by at least two of the gears as it traverses the joint.

As previously described, the open spaces between the teeth reduce to a minimum the likelihood of accumulation of debris. Furthermore, any debris which does accumulate between adjacent pins will be removed as that portion of the carrier traverses one or more of the pinion gears.

A plate 60 depends from the end of each frame adjacent the outer end of the actuator 52 for disposal opposite a plate 61 welded in position between the plates 29 and 30 of the main body portion. The plates 60 and 61 are provided with cam slots 60A and 61A, respectively, therethrough to receive the follower rod 62 of a manually manipulatable arm 63 which extends through the main body and the carrier to dispose its outer end adjacent the end of the apparatus, and thus easily accessible to a diver.

Figure 9:
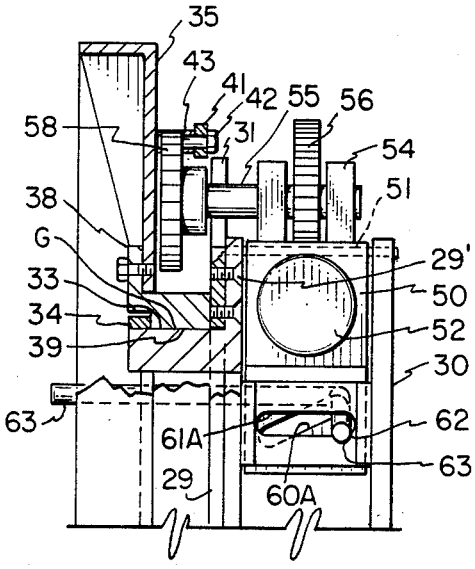
FIG. 9 is an end view of the means for rotating the carrier as shown in FIG. 7.
Figure 10:
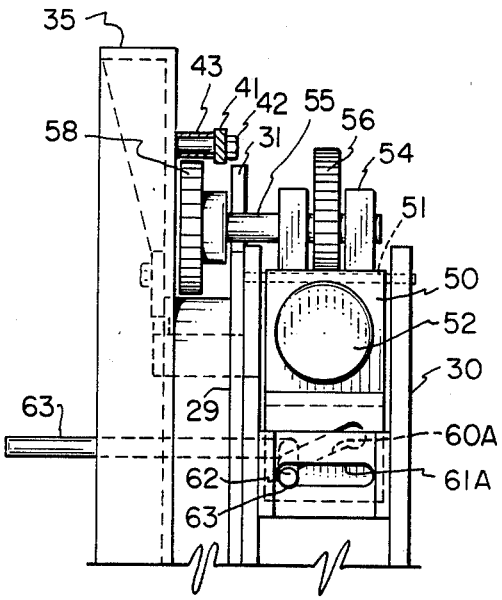
FIG. 10 is an end view of the means for rotating the carrier upon movement of the pinion gear into disengaged position, as shown in FIG. 8.

During normal operation, the follower 62 rests within a detent groove 63A in the slot 61A so as to support the end of the frame and thus maintain the pinion gear mounted thereon drivingly engaged with the pins forming the partial ring of teeth on the carrier. However, the slot 60A is inclined, as shown in FIGS. 9 and 10, so that when the arm 63 is pulled outwardly, the follower will engage the upper surface of the slot 60A in plate 60 of the frame 50 so as to raise the end of the frame and cause it to swing about the pin 57. This in turn will move the pinion gear out of driving engagement with the partial ring of teeth on the carrier, and enable the carrier to be rotated manually about the main body portion. Thus, if power for the actuator should be lost, or the actuator otherwise rendered inoperable to return the carrier to a position in which its throat is aligned with the throat in the main body portion, pulling of the arm 63 in the manner described will disengage the pinion gear to permit the carrier to be manually rotated to a position in which its throat is aligned with the throat of the main body portion.

From the foregoing it will be seen that this invention is one well adapted to attain all of the ends of objects hereinabove set forth, together with other advantages which are obvious and which are inherent to the apparatus and method.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed and desired to be secured by Letters Patent is:

1. Apparatus for use in inspecting, cleaning and/or performing other tasks in connection with a welded joint between intersecting tubular members of an offshore platform which are located a substantial depth beneath the water surface, comprising a support body including a main portion having a throat in one side thereof so that it may be moved onto one of the tubular members whose peripheral end edge is welded to the other member, and means connected to the main portion for movement between outer positions to the side of the throat to permit the body to be moved onto or removed from the one member, and inner position tightly engaged with the one member for clamping the body thereabout, a carrier mounted on the support body for rotation thereabout and having a throat in one side thereof which, when the carrier is in a first rotative position, is generally aligned with the body throat to permit the carrier to be moved with the body onto or removed from the one tubular member, said carrier having means thereon for inspecting and/or cleaning the joint as the carrier is rotated into other positions about the body, and means responsive to the supply of power from a remote source for moving the clamping means between inner and outer positions, rotating the carrier about the body, and activating the means for inspecting, cleaning and/or performing other tasks in connection with the joint, said means for rotating the carrier comprising pins mounted on the carrier in circumferentially spaced relation to form a partial ring of teeth extending concentrically of the axis of rotation of the carrier generally from one side to the other of the throat in the carrier, pinion gears mounted on the main body portion with their teeth arranged to successively move into and out of the open spaces between the pins in order to rotate the carrier upon rotation of the pinion gears, and means on the body for so rotating the pinion gears.

2. The apparatus as described in claim 1, wherein the means for rotating each gear comprises a frame mounted on the body, a shaft rotatably mounted on the frame and on which the pinion gear is mounted, a second gear on the shaft, and a double acting, hydraulically operated actuator having a rod with a worm thereon engaging the second gear for rotating it in response to reciprocation of the rod.

3. The apparatus as described in claim 1 wherein the main body portion has an outer circumferential groove arranged concentrically of the axis of rotation of the carrier and extending between opposite sides of the throat in the main body portion, the carrier has an inner circumferential flange guidably slidable in the groove, the pins are disposed generally radially opposite and outwardly from the flange, and the pinion gears are disposed radially intermediate the pins and flange.

4. Apparatus for use in inspecting, cleaning and/or performing other tasks in connection with a welded joint between intersecting tubular members of an offshore platform which are located a substantial depth beneath the water surface, comprising a support body including a main portion having a throat in one side thereof so that it may be moved onto one of the tubular members whose peripheral end edge is welded to the other member, and means connected to the main portion for swinging between outer positions to the side of the throat to permit the body to be moved onto or removed from the one member, and inner positions tightly engaged with the one member for clamping the body thereabout, a carrier mounted on the support body for rotation thereabout and having a throat in one side thereof which, when the carrier is in a first rotative position, is generally aligned with the body throat to permit the carrier to be moved with the body onto or removed from the one tubular member, said carrier having means thereon for inspecting and/or cleaning the joint as the carrier is rotated into other positions about the body, and means responsive to the supply of power from a remote source for moving the clamping arms between their inner and outer positions, rotating the carrier about the body, and activating the means for inspecting, cleaning and/or performing other tasks in connection with the joint, said means for rotating the carrier comprising means on the carrier forming a partial ring of circumferentially spaced teeth extending concentrically of the axis of rotation of the carrier generally from one side to the other of the throat in the carrier, pinion gears mounted on the main body portion for moving between positions drivingly engaged with and disengaged from the teeth, means including a remotely operable actuator on the main body portion for rotating the pinion gears so as to rotate the carrier when the gears are drivingly engaged with the teeth, and manually manipulatable means for moving the gears between said positions so that the gears may be moved out of driving engagement with the teeth to permit the carrier to be rotated independently of the actuators.

5. The apparatus as described in claim 4, wherein each gear and actuator are mounted on a frame which is pivotally mounted on the main body portion, and a shaft is journaled on the frame to connect the pinion gear with the actuator.

6. The apparatus as described in claim 5, wherein each of the carrier and frame have cam slots therein, and the manually manipulatable means comprises a follower arm extending through the slots and a rod on the arm having an outer end which may be manipulated to move the follower laterally within the slots, said slots being so contoured as to swing the frame between said positions as the rod is so manipulated.

* * * * *